US006098903A

United States Patent [19]

Touvelle et al.

[11] Patent Number: 6,098,903

[45] Date of Patent: Aug. 8, 2000

[54] FUEL INJECTOR WITH SOLENOID AND TERMINAL ASSEMBLIES

[75] Inventors: Matthew S. Touvelle, Peoria; Thomas R. Springer, Pekin; Jeffrey R. Ries, Germantown Hills; James J. Streicher, Pontiac, all of Ill.; David V. Teel, Columbus; Van A. Flamion, Roanoke, both of Ind.

[73] Assignee: Caterpillar Inc., Peoria, Ill.

[21] Appl. No.: 09/210,972

[22] Filed: Dec. 14, 1998

Related U.S. Application Data

[60] Provisional application No. 60/068,211, Dec. 19, 1997.

[51] Int. Cl.[7] ..... B05B 1/00

[52] U.S. Cl. ..... 239/585.1; 239/600

[58] Field of Search ..... 239/585.1–585.5, 239/600; 439/367, 369, 371

[56] References Cited

U.S. PATENT DOCUMENTS

| | | | |
|---|---|---|---|
| 4,342,443 | 8/1982 | Wakeman | 251/137 |
| 4,552,311 | 11/1985 | Casey | 239/585 |
| 4,646,976 | 3/1987 | Rembold | 239/585.3 |
| 4,702,540 | 10/1987 | Siemon | 439/371 |
| 4,836,453 | 6/1989 | Poehlman | 239/585.3 |
| 4,964,571 | 10/1990 | Taue et al. | 239/88 |
| 5,009,390 | 4/1991 | McAuliffe, Jr. et al. | 251/129.2 |
| 5,150,842 | 9/1992 | Hickey | 239/585.4 |
| 5,183,209 | 2/1993 | Ricco et al. | 239/585.3 |
| 5,189,782 | 3/1993 | Hickey | 29/602.1 |
| 5,190,223 | 3/1993 | Mesenich | 239/585.5 |
| 5,339,063 | 8/1994 | Pham | 335/260 |
| 5,358,181 | 10/1994 | Tani et al. | 239/409 |
| 5,551,398 | 9/1996 | Gibson et al. | 123/446 |

FOREIGN PATENT DOCUMENTS

| | | | |
|---|---|---|---|
| 334558 | 3/1989 | European Pat. Off. | F02D 1/08 |
| 0 525 442 | 2/1993 | European Pat. Off. | F02M 51/06 |
| 819845 A1 | 7/1997 | European Pat. Off. | F02M 55/00 |
| 2 198 289 | 6/1988 | United Kingdom | F02M 51/08 |

*Primary Examiner*—Kevin Weldon
*Attorney, Agent, or Firm*—Michael McNeil

[57] ABSTRACT

A fuel injector includes an injector body defining a terminal passage extending between a solenoid cavity and an outer surface. A solenoid assembly is press fit attached to the injector body and received in the solenoid cavity. The solenoid assembly includes a bobbin sandwiched between an upper magnetic flux carrier and a lower magnetic flux carrier. At least one of the flux carriers is plastically deformed when the solenoid assembly is attached to the injector body. A terminal assembly has an external terminal, an electrical conductor and a sealing member surrounding a portion of the electrical conductor. A portion of the electrical conductor and the sealing member are received in the terminal passage. A clamp is in contact with the outer surface of the injector body and the terminal assembly.

20 Claims, 6 Drawing Sheets

FUEL INJECTOR WITH SOLENOID AND TERMINAL ASSEMBLIES

CROSS REFERENCE TO RELATED APPLICATIONS

This application claims the benefit of prior provisional patent application Ser. No. 60/068,211 filed Dec. 19, 1997.

TECHNICAL FIELD

The present invention relates generally to electronically controlled fuel injectors, and more particularly to solenoid and terminal assemblies for fuel injectors.

BACKGROUND ART

An example of an electronically controlled fuel injector is shown in U.S. Pat. No. 5,551,398 to Gibson et al. Fuel injection is controlled in this injector with a single solenoid that has the ability to move two separate armatures. A fuel spillage valve member is attached to a first armature, and a needle control valve member is attached to a second armature. When the spill valve member is in its open position, fuel pressure cannot build within the fuel injector. Upon closing the spill valve member, fuel is trapped within the injector and a plunger moves downward to pressurize fuel. The plunger is mechanically driven downward by a cam/rocker arm and tappet assembly. When fuel pressure builds within the injector and the needle control valve member is in its on position, fuel will commence to spray out of the nozzle outlet when the fuel pressure is above a valve opening pressure sufficient to overcome a needle check return spring. When fuel pressure is high and the needle control valve member is in its off position, high pressure fuel is directed to a closing hydraulic surface on one end of the needle check to close the same to provide an abrupt end to an injection event.

In this injector, the solenoid must necessarily be positioned deep within the injector body, and electricity to energize the solenoid must be brought from the outside of the injector body to the solenoid assembly. In this prior art injector, the solenoid assembly is glued into the injector body. Engineers are often seeking ways to improve the sealing of the injector body against leakage, especially where the electrical conductors penetrate the injector body. Furthermore, engineers are often looking for ways to improve solenoid assemblies and terminal assemblies in order to decrease complexity during production by making the terminal and solenoid assemblies as separate integral components with decreased part counts. In addition, by improving the mating between these sub assemblies and an injector body, the robustness and working life of an injector when fully assembled can be improved.

The present invention is directed to improving solenoid assemblies, terminal assemblies and fuel injectors that utilize both.

DISCLOSURE OF THE INVENTION

A valve terminal assembly includes a valve body defining an inner cavity, an outer surface and a terminal passage extending between the inner cavity and the outer surface. A terminal assembly has an external terminal and one of a male electrical connector and a female electrical connector attached to a terminal housing. A portion of the terminal assembly containing the electrical connector is received in the terminal passage. A clamp is in contact with the valve body and the terminal assembly.

In another embodiment of the present invention, a solenoid assembly includes a coil assembly having a bobbin with a wire winding. An upper magnetic flux carrier is attached to a lower magnetic flux carrier with the bobbin positioned there between. One of a male electrical connector and a female electrical connector is attached to the bobbin.

In still another embodiment of the present invention, a fuel injector includes an injector body defining a solenoid cavity, an outer surface and a terminal passage extending between the solenoid cavity and the outer surface. A solenoid assembly includes a coil assembly sandwiched between an upper magnetic flux carrier and a lower magnetic flux carrier. The solenoid assembly is press fit attached to the injector body and received in the solenoid cavity. At least one of the magnetic flux carriers are plastically deformed when the solenoid assembly is attached to the injector body. A terminal assembly has an external terminal, an electrical conductor and a sealing member surrounding a portion of the electrical conductor. A portion of the electrical conductor and the sealing member are received in the terminal passage. The sealing member is in sealing contact with the valve body within the terminal passage. A clamp is in contact with the outer surface of the injector body and the terminal assembly.

BEST MODE FOR CARRYING OUT THE INVENTION

Figure 1:
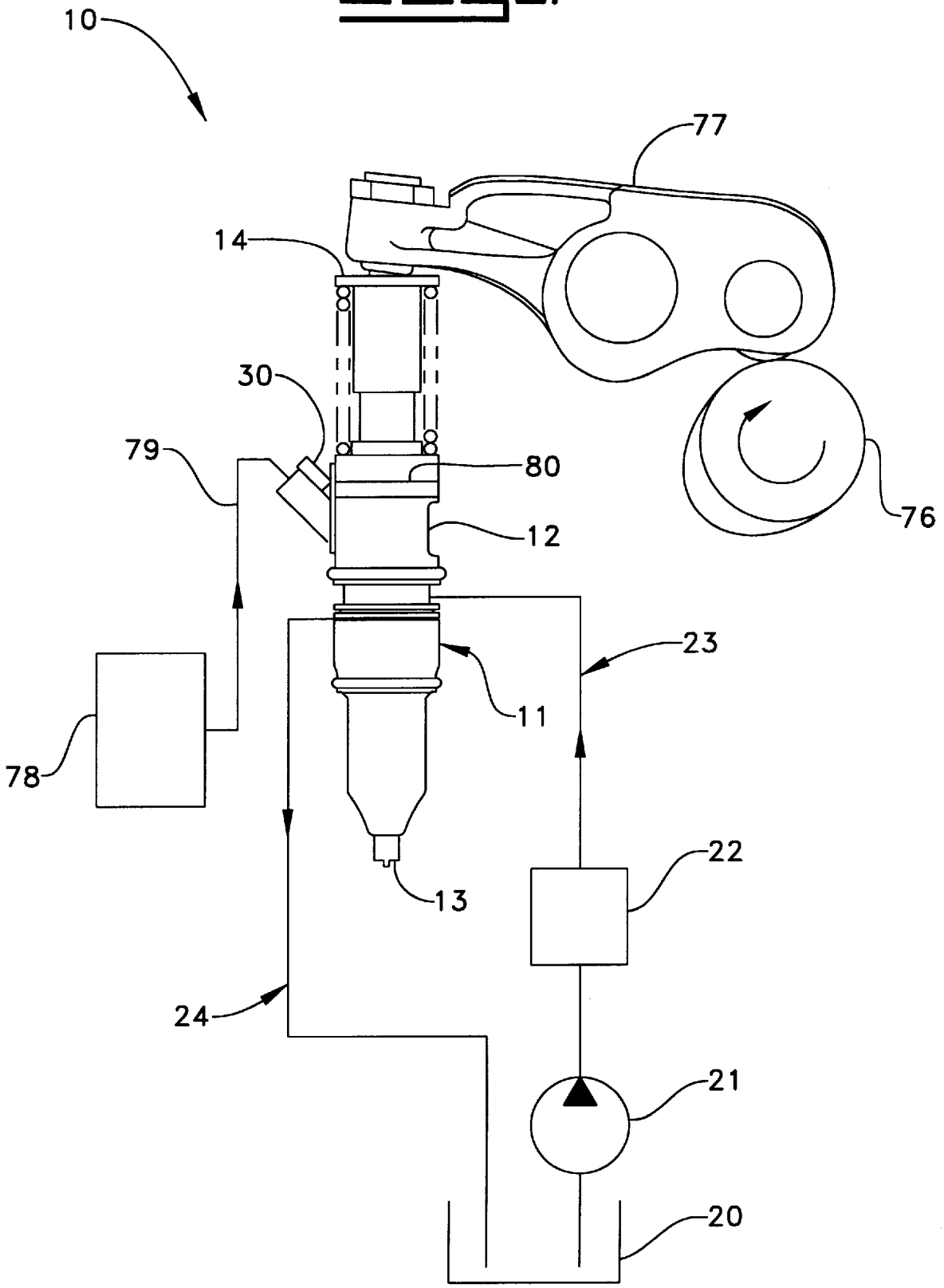
FIG. 1 is a schematic illustration of a fuel injection system utilizing a fuel injector according to one embodiment of the present invention.

In the drawings, the same reference numerals designate the same elements for features throughout all of the drawings.

Referring now to FIG. 1, a mechanically actuated electronically controlled fuel injection system 10 is illustrated. The system includes a plurality of fuel injectors 11 (only one of which is shown) having an injector body 12, a nozzle outlet 13 and a tappet 14. With each revolution of an engine, a cam 76 is rotated in contact with rocker arm assembly 77. With each rotation of cam 76, tappet 14 is driven downward to pressurize fuel within injector 11. Fuel is supplied to injector 11 from a fuel tank 20. Fuel is drawn from tank 20 by a relatively low fuel transfer pump 21 through fuel filters 22 and into fuel supply passage 23. A fuel return passage 24 connects a spill passage within injector 11 with fuel tank 20 to recirculate spilled fuel. A solenoid actuated control valve within injector 11 receives power via a terminal assembly 30 that is clamped via a circumferential band clamp 80 to the outer surface of injector 11. An electronic control module 78 controls the energization and de-energization of the solenoid within injector 11 via a communication line (i.e. current) 79 in a conventional manner.

Figure 2:
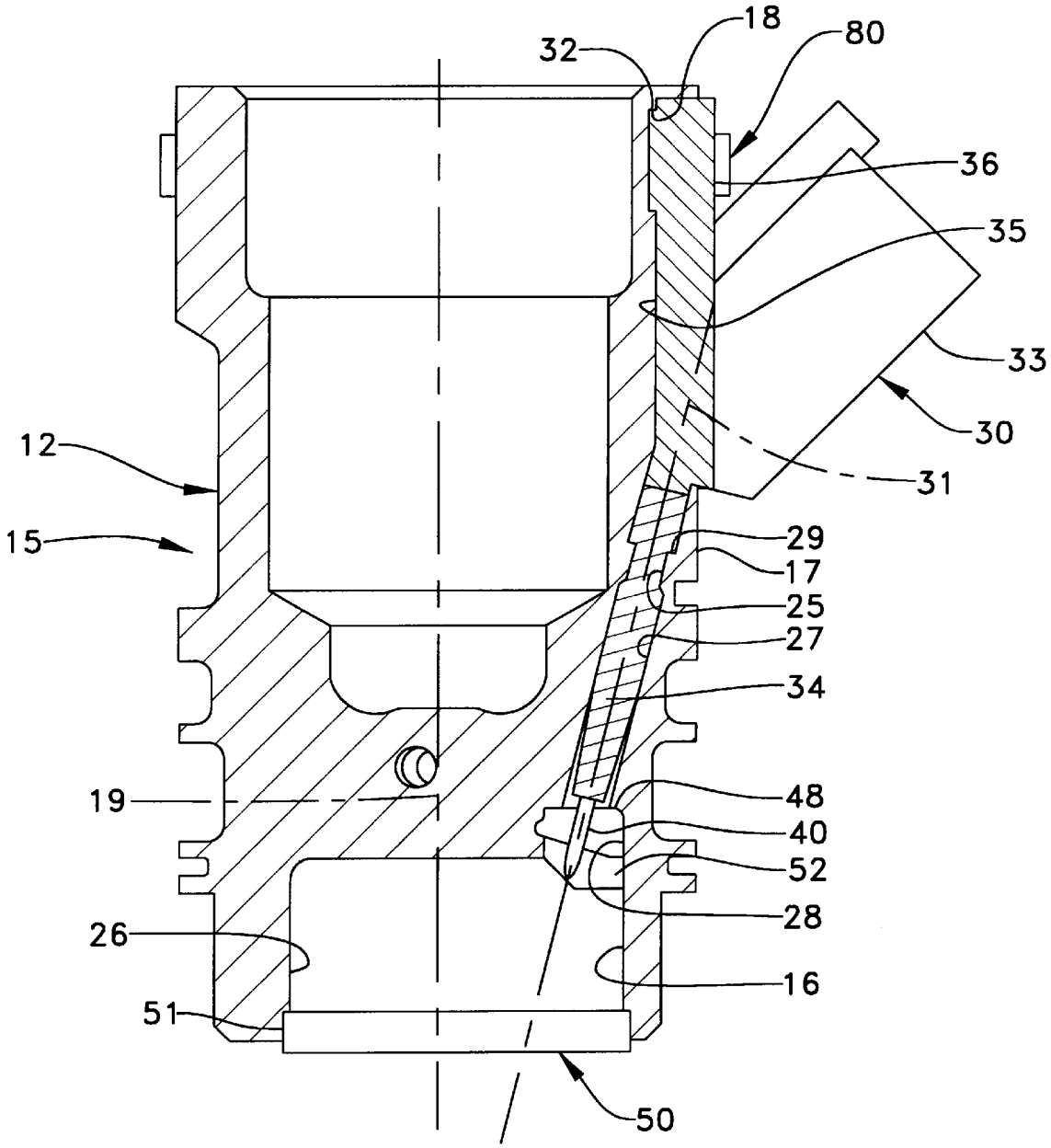
FIG. 2 is a sectioned side elevational view of an injector body/solenoid/terminal assembly according to one embodiment of the present invention.

Referring now to FIG. 2, a fuel injector valve terminal assembly 15 is illustrated. The assembly includes an injector body component 12 made from a suitable metallic alloy into a generally cylindrical shape about a centerline 19. Valve body component 12 is machined to include an inner solenoid cavity 16 and a terminal passage 27 extending between solenoid cavity 16 and an outer surface 17. The centerline 31 of terminal passage 27 is preferably oriented at an angle on the order of about 15° to 25° with respect to the centerline 19 of injector valve body component 12. A solenoid assembly 50 is press fit attached to body component 12 and received in solenoid cavity 16. In particular, a raised annular ridge 51 is partially plastically deformed when solenoid assembly 50 is pressed into inner cavity 16 and raised annular ridge 51 comes in contact with press fit interference zone 26, which defines a portion of the cavity. The term "annular" includes less than a full circle in the case of annular ridge 51 because in some instances it may be desirable to include a slit to accommodate plastic cover 56, etc. A portion of solenoid cavity 16 is a grommet cavity 28 that receives a grommet seal 52, which is a portion of solenoid assembly 50. The sealing contact between grommet seal 52 and grommet cavity 28 is intended to at least partially prevent fuel or another fluid surrounding solenoid assembly 50 from coming into contact with a male/female electrical connection 48 that is used to supply current to the coil within solenoid assembly 50.

A terminal assembly 30 is mated to solenoid assembly 50 and injector body 12. Terminal assembly 30 includes a plastic terminal housing 33 shaped to include a rounded contact surface 35 that conforms to outer surface 17 and a locating projection 32 that is positioned in contact with a locating surface 18. Terminal assembly 30 held in place with a circumferential band clamp 80 that is in contact with both terminal assembly 30 and outer surface 17 of body component 12. A portion of terminal assembly 30 containing an electrical conductor is received in terminal passage 27. Terminal passage 27 has an enlarged diameter portion, a reduced diameter area 25 and a pin face seal area 29. A portion of terminal assembly 30 is a sealing member 34 that surrounds an inner electrical conductor. Sealing member 34 is tapered to ensure that somewhere along its length appropriate compression takes place to seal terminal passage 27. Sealing member 34 makes sealing contact with terminal passage 27 in order to further prevent the leakage of any fluid that gets past grommet seal 52 from escaping to outer surface 17. A different portion of sealing member 34 comes in contact with pin face seal area 29 to prevent entry of contaminates from outside of body component 12 into solenoid cavity 16. Sealing member 34 is compressed against pin face seal 29 to produce a mechanical preload when locating projection 32 is positioned against locating surface 18. This preload maintains locating projection 32 in contact with locating surface 18 to ensure that terminal assembly 30 is properly located and stabilized during vibrations. Terminal assembly 30 includes one of a male electrical connector and a female electrical connector, and solenoid assembly 50 includes the other of a male and female electrical connector.

Figure 3:
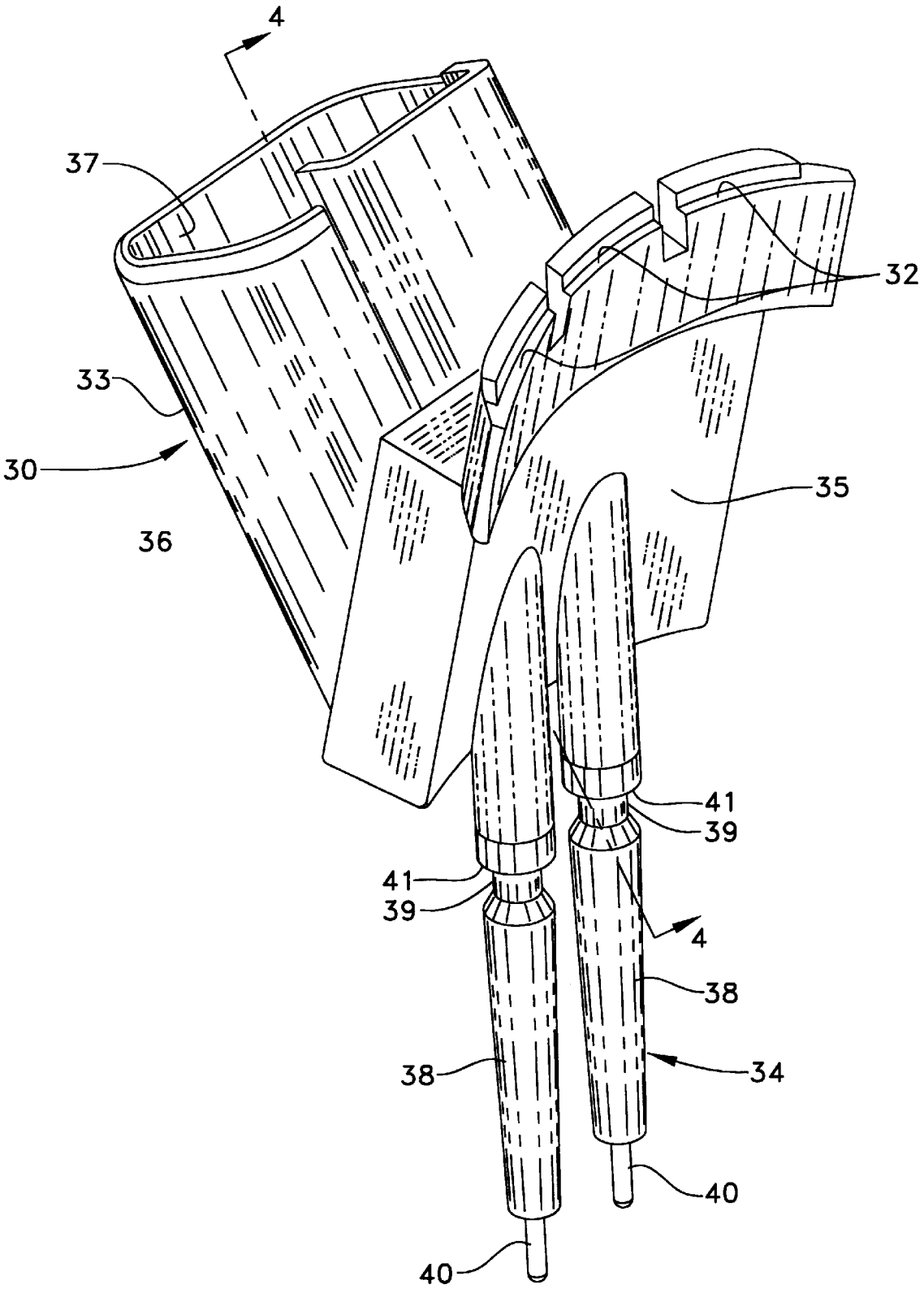
FIG. 3 is an isometric view of a terminal assembly according to one aspect of the present invention.
Figure 4:
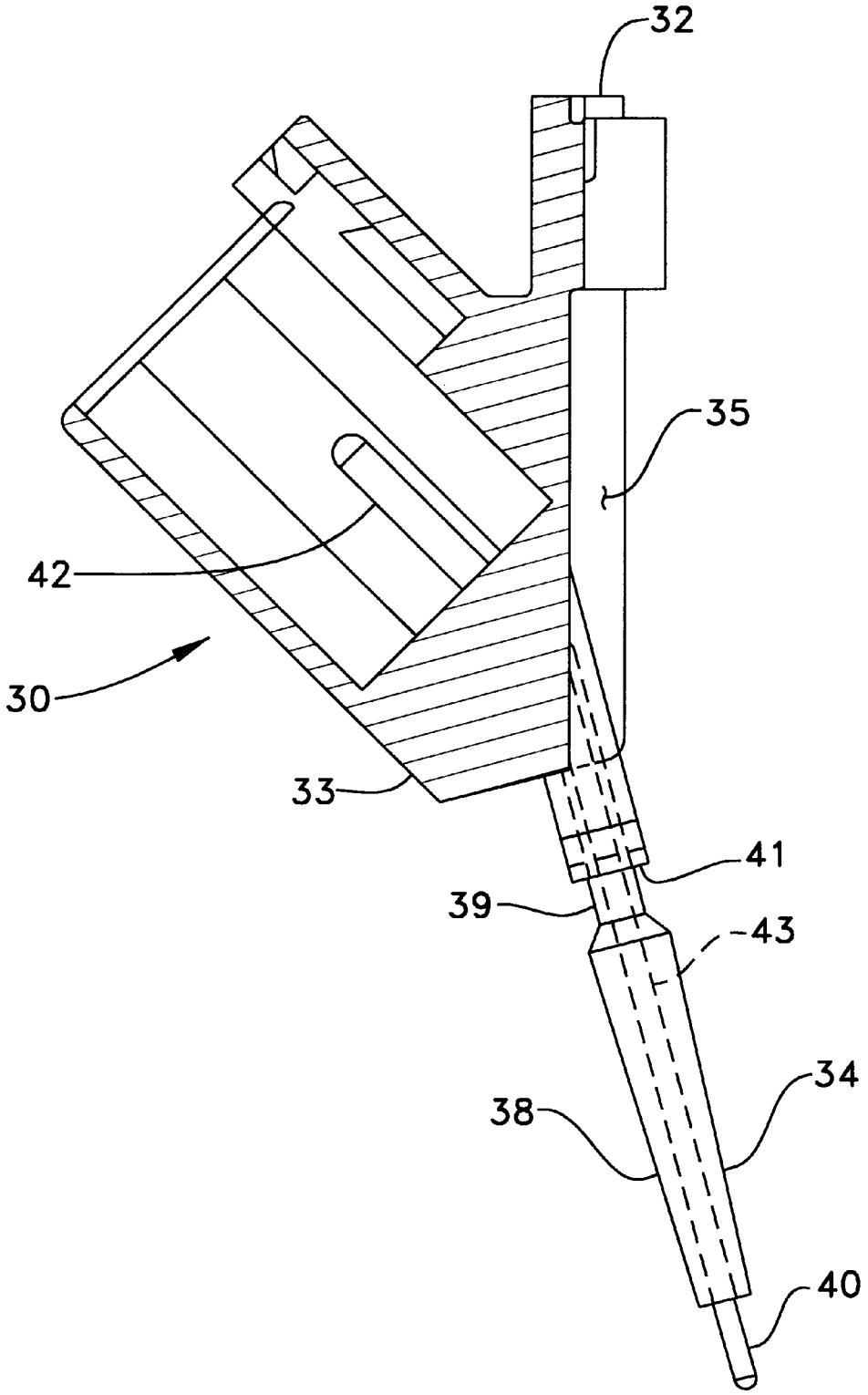
FIG. 4 is a sectioned side elevational view of a terminal assembly as viewed along section lines 4—4 of FIG. 3.

Referring now to FIGS. 3 and 4, terminal assembly 30 includes a pair of external terminals 42 electrically connected to a pair of male electrical connectors 40 via a pair of separate electrical conductors 43. A plastic terminal housing 33 is molded, preferably of nylon, around a portion of the electrical components to include rounded contact surface 35, locating projection 32, a connector receptacle opening 37, and a clamping surface 36. Another portion of the electrical components has a sealing member 34, preferably made of a rubber type material, molded there around. Sealing member 34 includes a tapered portion 38 to create an appropriate seal when received in terminal passage 27. An annular face seal 41 comes in sealing contact with pin face seal 29 when terminal assembly 30 is mated to injector valve body component 12 as shown in FIG. 2. Terminal assembly 30 is preferably an integral component consisting essentially of only five attached parts: a pair of electrical conductors, a terminal housing 33 and a pair of sealing members 34.

Figure 5:
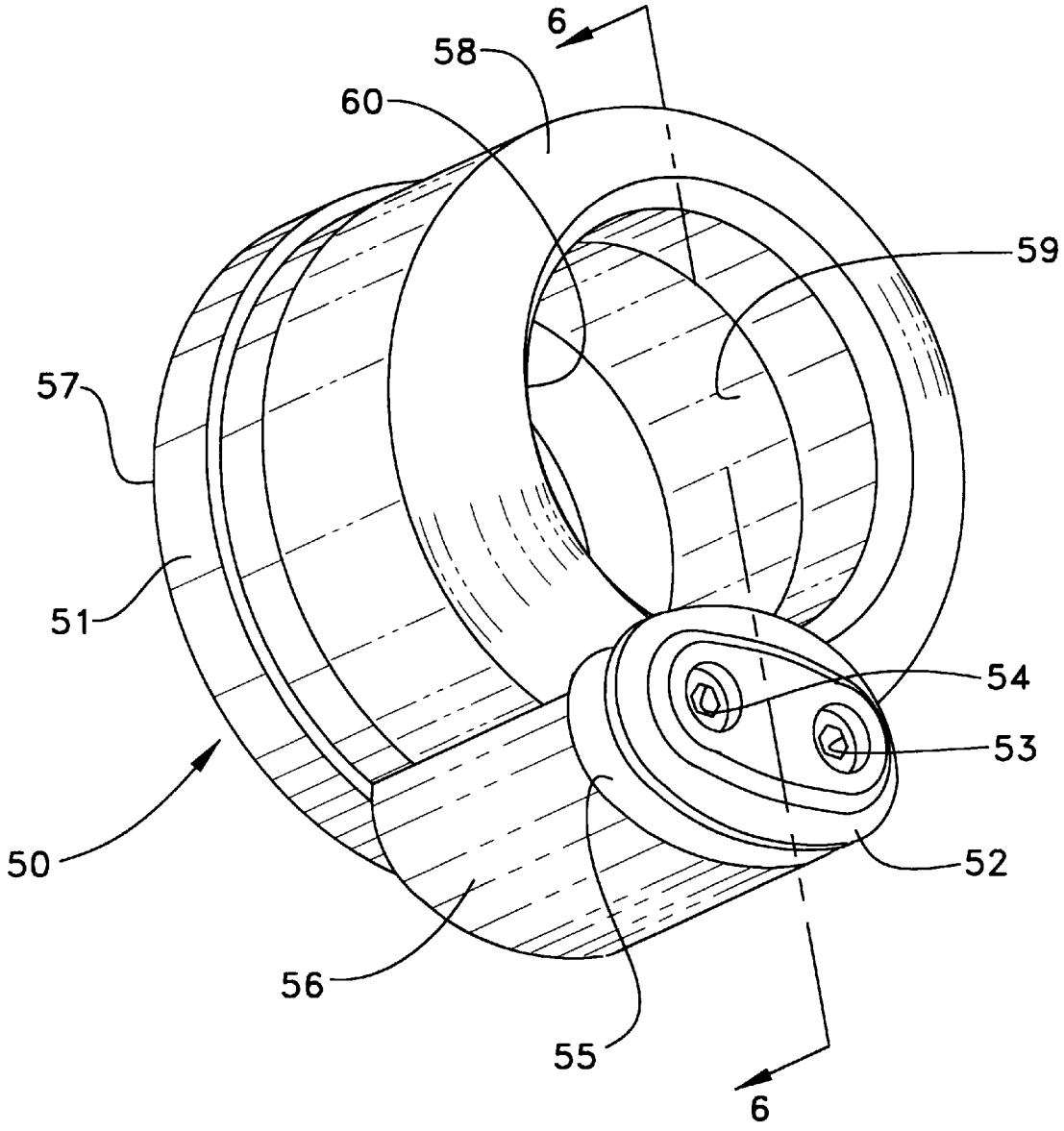
FIG. 5 is an isometric view of a solenoid assembly according to one embodiment of the present invention.
Figure 6:
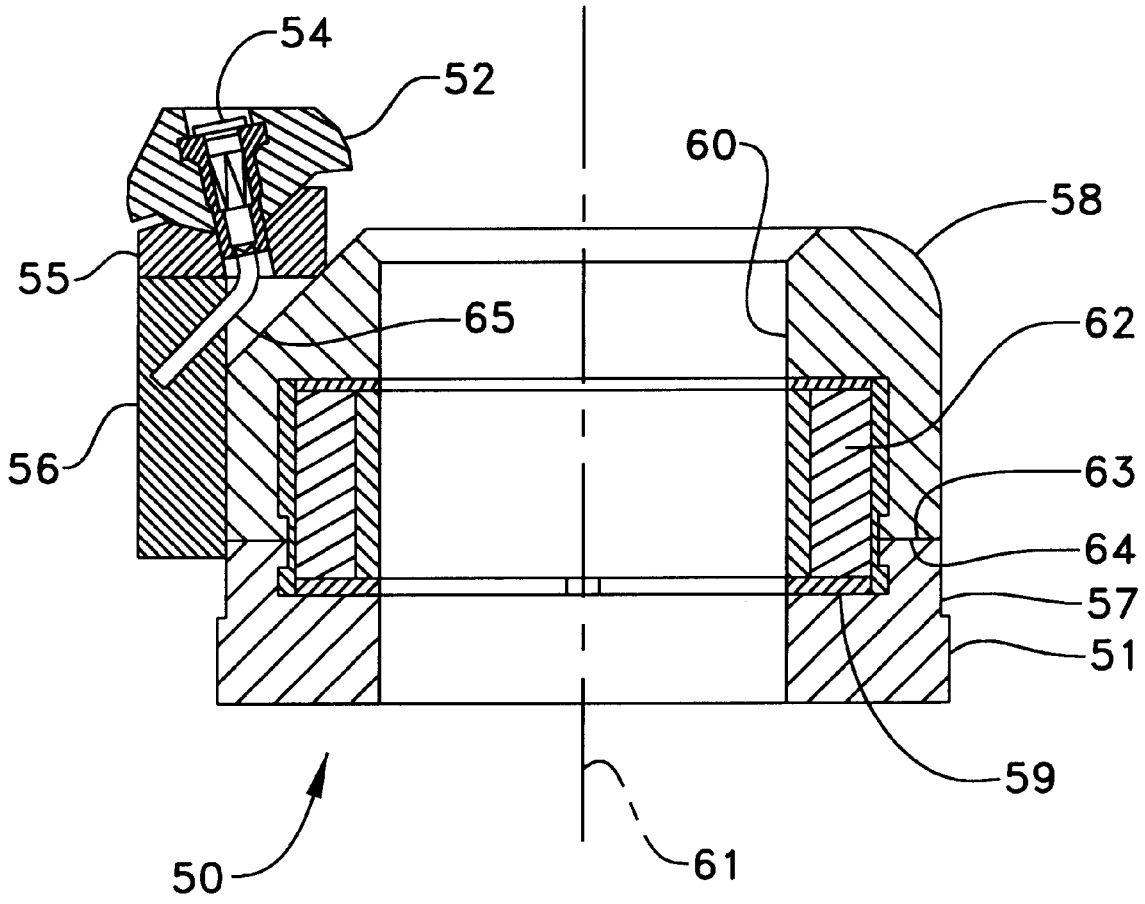
FIG. 6 is a sectioned side elevational view of a solenoid assembly as viewed along section lines 6—6 of FIG. 5.

Referring now to FIG. 5, the inner structure and outer shape of solenoid assembly 50 are illustrated. Solenoid assembly 50 includes a coil assembly having a bobbin 59 with a wire winding 62 sandwiched or positioned between an upper magnetic flux carrier 58 and a lower magnetic flux carrier 57. The magnetic flux carriers are preferably made from a material such as soft silicon steel. Upper and lower magnetic flux carriers 58 and 57 are attached to one another through a press or crush fit such that one or both undergo a permanent plastic deformation where the two pieces contact. In this case, upper magnetic flux carrier 58 includes an annular insert portion 64 that deforms when it is received in a counterbore lower interference zone 63 formed in lower magnetic flux carrier 57. Lower magnetic flux carrier 57 includes a raised annular ridge 51, as discussed earlier, that plastically deforms creating a press fit when solenoid assembly 50 is received in solenoid cavity 16. Thus, the only real contact between solenoid assembly 50 and injector body component 12, when assembled, exists between raised annular ridge 51 and press fit interference zone 26, and the contact between grommet seal 52, which is preferably made from a non-electrically conducting resilient material such as rubber, and grommet cavity 28.

Upper magnetic flux carrier 58 includes a slot that allows a plastic carrier 55 and electrical conductor 65 to be attached to bobbin 59. Electrical conductor 65 includes a female electrical connector 54 concealed within grommet seal 52. A plastic cover 56 protects the otherwise exposed portion of electrical conductor 65, which is attached to exposed leads of wire winding 62. When assembled, upper magnetic flux carrier 58, bobbin 59 and lower magnetic flux carrier 57 share a common centerline 61 and define a central cylindrical cavity, within which are positioned a pair of armatures when the injector is fully assembled. After the various components of solenoid assembly 50 are positioned and attached as shown, epoxy is injected in the area around bobbin 59 and the other components in order to make solenoid assembly 50 behave as an integral component, to ease assembly during production. The female electrical connectors 53 and 54 of solenoid assembly 50 mate with the counterpart male electrical connectors 40 of terminal assembly 30 when the two assemblies are attached to injector valve body component 12 as shown in FIG. 2.

The female electrical connectors 53 and 54 are oriented at about the same angle with respect to common centerline 61 as terminal passage centerline 31 is oriented with respect to body centerline 19.

INDUSTRIAL APPLICABILITY

The present invention finds potential application in any valve that utilizes a solenoid that is positioned within the valve body. The present invention is particularly applicable for incorporation into the design of electronically controlled fuel injectors. The present invention is particularly applicable as an improvement on one class of mechanically actuated electronically controlled fuel injectors of the type manufactured by Caterpillar, Inc. of Peoria, Ill. and described for instance in U.S. Pat. No. 5,551,398 to Gibson et al.

Referring back to FIG. 2, when the various components are assembled, solenoid assembly 50 is first press fit into attachment with body component 12. Next, the male electrical connector portions of terminal assembly 30 are advanced through terminal passage 27 until locating protrusion 32 can be positioned against locating surface 18. The mating of these two surfaces ensures that an adequate electrical mating connection exists between the male and female electrical connectors. In addition, the terminal assembly is preferably designed such that the positioning of the locating surfaces ensures that the sealing member 34 is in its proper position to both maintain against leakage from the inside of body component 12 to the outside, and vice versa. The use of a circumferential clamp 80 combined with the orientation of locating surface 18 ensures that terminal assembly 30 cannot work itself loose from its position attached to body component 12 when a complete injector experiences vibrations and other disturbances during its working life. Because the solenoid assembly 50 and terminal assembly 30 are essentially separate integral components, assembly of complete injectors is significantly simplified over the multi-component sub assemblies of the prior art. The present invention prefers the use of a circumferential band clamp to hold terminal assembly 30 in place, but other clamping means, such as a retaining ring, etc. could be substituted in its place. In addition, in some instances, the use of fasteners may be possible if the same can be accomplished without weakening or otherwise causing distortion to the valve body component 12, which often is a highly stressed component in a fuel injector. Thus, fasteners can also be considered as clamps in relation to the present invention.

Those skilled in the art will appreciate the numerous modifications and alternative embodiments of the present invention that are apparent in view of the foregoing description. Accordingly, this description is to be construed as illustrative only, and is for the purpose of teaching those skilled in the art the best mode of carrying out the invention. The details of the structure may be varied substantially without departing from the spirit of the invention, the scope of which is defined in terms of the claims as set forth below.

We claim:

1. A valve terminal assembly comprising:

a valve body defining an inner cavity, an outer surface and a terminal passage extending between said inner cavity and said outer surface;

a terminal assembly having an external terminal and one of a male electrical connector and a female electrical connector affixed to a terminal housing;

a portion of said terminal assembly containing said one of a male electrical connector and a female electrical connector being received in said terminal passage; and a clamp in contact with said valve body and said terminal assembly.

2. The valve terminal assembly of claim 1 wherein said terminal assembly includes a sealing member surrounding a portion of said one of a male electrical connector and a female electrical connector; and said sealing member being in sealing contact with said valve body within said terminal passage.

3. The valve terminal assembly of claim 1 wherein said clamp is a circumferential band clamp positioned around said valve body.

4. The valve terminal assembly of claim 1 wherein said terminal housing is made of plastic and molded around a portion of said external terminal and a portion of said one of a male electrical connector and a female electrical connector.

5. The valve terminal assembly of claim 1 wherein said terminal passage is a first terminal passage, and said valve body defines a second terminal passage;

said one of a male electrical connector and a female electrical connector is a first male electrical connector, and said terminal assembly includes a second male electrical connector; and a first portion of said terminal assembly containing said first male electrical connector being received in said first terminal passage, and a second portion of said terminal assembly containing said second male electrical connector being received in said second terminal passage.

6. The valve terminal assembly of claim 1 wherein said valve body has a valve centerline;

said terminal passage has a passage centerline oriented at an acute angle with respect to said valve centerline.

7. A solenoid assembly comprising:

a bobbin with a wire winding;

an upper magnetic flux carrier;

a lower magnetic flux carrier attached to said upper magnetic flux carrier with said bobbin positioned there between; and one of a male electrical connector and a female electrical connector attached to said bobbin.

8. A solenoid assembly comprising:

a bobbin with a wire winding;

an upper magnetic flux carrier;

a lower magnetic flux carrier attached to said upper magnetic flux carrier with said bobbin positioned there between;

one of a male electrical connector and a female electrical connector attached to said bobbin;

wherein said upper magnetic flux carrier is press fit attached to said lower magnetic flux carrier; and at least one of said upper magnetic flux carrier and said lower magnetic flux carrier being plastically deformed when being attached together.

9. The solenoid assembly of claim 7 wherein said upper magnetic flux carrier, said lower magnetic flux carrier and said bobbin share a common centerline; and said one of a male electrical connector and a female electrical connector is oriented at an acute angle with respect to said centerline.

10. The solenoid assembly of claim 7 wherein said upper magnetic flux carrier, said lower magnetic flux carrier and said bobbin define a central cylindrical cavity.

11. The solenoid assembly of claim 7 wherein a portion of said lower magnetic flux carrier is a raised annular ridge located away from said upper magnetic flux carrier.

12. A fuel injector comprising:

an injector body defining a solenoid cavity, an outer surface and a terminal passage extending between said solenoid cavity and said outer surface;

a solenoid assembly including a bobbin sandwiched between an upper magnetic flux carrier and a lower magnetic flux carrier, and being press fit attached to said injector body and received in said solenoid cavity, and at least one of said upper magnetic flux carrier and said lower magnetic flux carrier being plastically deformed when said solenoid assembly is attached to said injector body;

a terminal assembly having an external terminal, an electrical conductor and a sealing member surrounding a portion of said electrical conductor, and a portion of said electrical conductor and said sealing member being received in said terminal passage, and said sealing member being in sealing contact with said valve body within said terminal passage; and a clamp in contact with said outer surface of said injector body and said terminal assembly.

13. The fuel injector of claim 12 wherein said solenoid assembly includes one of a male electrical connector and a female electrical connector;

said terminal assembly includes an other of a male electrical connector and a female electrical connector; and said one of a male electrical connector and a female electrical connector being mated to said other of a male electrical connector and a female electrical connector.

14. The fuel injector of claim 13 wherein said clamp is a circumferential band clamp positioned around said injector body.

15. The fuel injector of claim 14 wherein said injector body and said solenoid assembly share a common centerline; and said terminal passage has a passage centerline oriented at an angle with respect to said centerline.

16. The fuel injector of claim 15 wherein an outer portion of said lower magnetic flux carrier is a raised annular ridge;

a portion of said solenoid cavity is defined by a press fit interference zone; and said raised annular ridge contacting said press fit interference zone and undergoing plastic deformation when said solenoid assembly is attached to said injector body.

17. The fuel injector of claim 16 wherein said terminal passage is a first terminal passage, and said injector body defines a second terminal passage;

said one of a male electrical connector and a female electrical connector is a first male electrical connector, and said terminal assembly includes a second male electrical connector; and a first portion of said terminal assembly containing said first male electrical connector being received in said first terminal passage, and a second portion of said terminal assembly containing said second male electrical connector being received in said second terminal passage.

18. The fuel injector of claim 17 wherein said solenoid assembly defines a central cylindrical cavity.

19. The fuel injector of claim 18 wherein said upper magnetic flux carrier is press fit attached to said lower magnetic flux carrier; and at least one of said upper magnetic flux carrier and said lower magnetic flux carrier being plastically deformed when being attached together.

20. The fuel injector of claim 19 wherein said terminal housing is made of plastic and molded around a portion of said external terminal and a portion of said first male electrical connector and said second male electrical connector.

* * * * *